US005316623A

United States Patent [19]

Espy

[11] Patent Number: 5,316,623

[45] Date of Patent: May 31, 1994

[54] ABSORBANCE AND PERMANENT WET-STRENGTH IN TISSUE AND TOWELING PAPER

[75] Inventor: Herbert H. Espy, Wilmington, Del.

[73] Assignee: Hercules Incorporated, Wilmington, Del.

[21] Appl. No.: 803,862

[22] Filed: Dec. 9, 1991

[51] Int. Cl.[5] ..... D21H 17/72

[52] U.S. Cl. ..... 162/164.3; 162/164.6; 162/168.2; 162/168.3; 162/175; 162/176; 162/177; 162/178; 162/183

[58] Field of Search ..... 162/175, 176, 177, 178, 162/164.3, 168.2, 164.6, 183, 168.3

[56] References Cited

U.S. PATENT DOCUMENTS

| | | | |
|---|---|---|---|
| 3,049,469 | 8/1962 | Davison | 162/164 |
| 3,058,873 | 10/1962 | Keim et al. | 162/164 |
| 3,224,986 | 12/1965 | Butler et al. | 260/9 |
| 3,332,834 | 7/1967 | Reynolds, Jr. | 162/164 |
| 3,483,077 | 12/1969 | Aldrich | 162/158 |
| 3,660,338 | 5/1972 | Economou | 260/29.6 |
| 3,677,888 | 7/1972 | Economou | 162/164 |
| 3,790,514 | 2/1974 | Economou | 260/17.4 |
| 3,998,690 | 12/1976 | Lyness et al. | 162/141 |
| 4,218,286 | 8/1980 | Jones et al. | 162/177 |

FOREIGN PATENT DOCUMENTS

| | | | |
|---|---|---|---|
| 799369 | 11/1968 | Canada | 162/164.3 |
| 0097974 | 1/1984 | European Pat. Off. . | |
| 1546369 | 5/1970 | Fed. Rep. of Germany . | |

OTHER PUBLICATIONS

Proceedings of the 1983 TAPPI Papermakers Conference, Portland, Org. pp. 191–195.

Reynolds, Chapter 6 in "Dry Strength Additives", W. F. Reynolds, ed. TAPPI Press, Atlanta, 1980, p. 141, FIG. 6–9.

*Primary Examiner*—Peter Chin

*Attorney, Agent, or Firm*—Roy V. Jackson

[57] ABSTRACT

A method for imparting wet strength to paper with improved water absorbency, that comprises adding to an aqueous suspension of cellulosic paper stock a neutral or alkaline-curing thermosetting wet-strength resin, a water-soluble polymer containing carboxyl groups or carboxylate ions as their alkali metal or ammonium salts, and a substantially non-thermosetting tertiary-amino polyamide-epichlorohydrin resin.

17 Claims, No Drawings

ABSORBANCE AND PERMANENT WET-STRENGTH IN TISSUE AND TOWELING PAPER

This invention relates to a method for imparting wet strength to paper with improved water absorbency.

BACKGROUND OF THE INVENTION

Papers used in tissue and toweling grades that require good absorbency also require a high level of wet strength in order to maintain their structural integrity under the mechanical stresses of removing moisture from skin and other surfaces. Measures needed to satisfy both these requirements tend to conflict.

For instance, the rate of absorption of water into paper is generally reduced by such effective wet-strength resins as acid-curing wet-strength resins like urea-formaldehyde and melamine-formaldehyde resins, and neutral- or alkaline-curing resins like polyaminoamide-epichlorohydrin, polyamine-epichlorohydrin, and other amine polymer-epichlorohydrin resins.

Of the permanent wet-strength resins, the neutral or alkaline-curing resins often produce a softer, more absorbent sheet than do the acid-curing urea-formaldehyde and melamine-formaldehyde resins, but they still reduce the rate of water absorption of the paper significantly.

On the other hand, neutral- or acid-curing resins containing aldehyde groups that have a less adverse effect on the rate of absorption, such as dialdehyde starch and glyoxal-modified acrylamide polymers, impart only temporary wet-strength.

With a permanent wet-strength resin, about 80 to 90 percent of the wet strength measured after 10 seconds soaking will persist after two hours soaking, while with a temporary wet-strength resin, typically only one-third to two-thirds of the "10-second" wet strength will persist after two hours.

It is known to use surface-active agents or debonders, dried into the sheet, to facilitate the penetration of water into the paper when it is wet by its use to wipe or dry the skin, but these agents concurrently weaken the dry strength of the sheet, which lowers the wet strength, because the absolute wet strength of a sheet made of a particular pulp under given conditions with a given amount of wet-strength resin will tend to be lowered in direct proportion to its dry strength.

It is known from U.S. Pat. Nos. 3,058,873, 3,049,469, and 3,998,690, and in the Proceedings of the 1983 TAPPI Papermakers Conference, Portland, Oreg., pp. 191–195, that the neutral or alkaline-curing thermosetting wet-strength resins become more effective in imparting wet strength and increasing dry strength, if they are used in conjunction with a water-soluble carboxyl-bearing polymers, such as carboxymethylcellulose (CMC).

It is also known, for instance from U.S. Pat. No. 3,049,469, to combine a thermosetting cationic wet-strength resin and an anionic polyacrylamide, for improved wet and dry tensile strengths in paper. However, it is also known, for instance from U.S. Pat. Nos. 3,332,834, 3,790,514, 3,660,338, and 3,667,888, that combinations of non-thermosetting cationic polymers with anionic water-soluble polymers, those containing carboxyl groups or carboxylate ions and anionic polymers and copolymers of acrylamide, or poly(acrylic acid) or its salts, will increase the dry strength of paper, while imparting little or no wet strength.

With these combinations, it is also known, for instance from Reynolds, Ch. 6 in "Dry Strength Additives", W. F. Reynolds, ed., TAPPI Press, Atlanta, 1980; FIGS. 6–9, p. 141, that the improvement in dry strength rises to a maximum, then declines as the ratio of anionic polymer to cationic polymer increases.

For use in tissue and toweling, it would be desirable to have a paper that, while maintaining needed dry strength, combines high permanent wet strength with rapid absorption of water.

SUMMARY OF THE INVENTION

The process according to the invention for making paper under neutral to alkaline conditions provides better absorbency as well as better wet and dry strength in paper towels or any other paper product requiring such properties.

The combination of good dry strength, good wet strength, and improved water absorbency is achieved by using a combination of three ingredients in the paper-making process. The three ingredients include:

Group (A): a neutral or alkaline-curing thermosetting wet-strength resin, which can belong to one of three subgroups: (A1), polyaminoamide-epichlorohydrin resins; (A2), polyamine-epichlorohydrin resins, and (A3), aminopolymer-epichlorohydrin resins.

(B). a water-soluble anionic polymer containing carboxyl groups or carboxylate ions (as their alkali metal or ammonium salts), anionic copolymers of acrylamide, or poly(acrylic acid) or its salts.

(C). a non-thermosetting tertiary-amino polyamide-epichlorohydrin resin.

DETAILED DESCRIPTION OF THE INVENTION

The three subgroups of the first ingredient (A): (A1), polyaminoamide-epichlorohydrin resins; (A2), polyamine-epichlorohydrin resins, and (A3), aminopolymer-epichlorohydrin resins, are more completely described below.

Subgroup (A1)

The thermosetting wet-strength resins of subgroup (A1) are known, for instance, from U.S. Pat. Nos. 2,926,154, 3,125,552, 3,887,510, 3,332,901, 3,311,594, 4,515,657, 4,537,657, and 4,501,862. They are made by the reaction of a polyaminoamide with an epihalohydrin, preferably epichlorohydrin. The reaction is run in aqueous solution, using a ratio of about 0.5 to about 2 moles of epihalohydrin per equivalent of amine nitrogen in the polyaminoamide. Temperatures can range from about 20° to about 80° C., and concentrations of reactants can range from about 10 to about 75% by weight. Suitable conditions for the reaction of a given polyaminoamide with epihalohydrin can be readily determined by experiment.

Details regarding the conventional polyaminoamides from which the thermosetting wet-strength resins of subgroup (A1) are set out below.

Subgroup (A2)

The thermosetting polyamine-epichlorohydrin wet-strength resins of subgroup (A2) known, for instance, from U.S. Pat. Nos. 4,147,586; 4,129,528, and 3,855,158. They are made by the reaction of one or more polyalkylenepolyamines with epichlorohydrin in aqueous solution. The polyamines are alkylenediamines and polyalkylene-polyamines of structure:

$$H_2N-[(CH_2)_m-N(R)-]_n-(CH_2)_m-NH_2,$$

in which m is between 2 and 6, n is between 1 and about 5, and R is chosen from among hydrogen and alkyl groups of 1 to 4 carbon atoms. Mixtures of two or more amines may be used. Further details regarding the conventional polyalkylenepolyamines from which the thermosetting polyamine-epichlorohydrin wet-strength resins of subgroup (A2) are made are set out below.

Subgroup (A3)

The amine polymer-epichlorohydrin wet-strength resins of subgroup (A3) are known, for instance, from U.S. Pat. Nos. 3,700,623, 3,833,531, and 3,772,076. They are made from polymers of diallylamines of structure $$CH_2=CHCH_2-N(R)-CH_2CH=CH2$$

in which R=hydrogen or an alkyl group of between 1 and 4 carbon atoms. Further details regarding the conventional polymers of diallylamines from which the amine polymer-epichlorohydrin wet-strength resins of subgroup (A3) are made are set out below.

Second Ingredient (B)

The water-soluble carboxyl-containing polymers (B) include carboxyalkylated polysaccharides such as carboxymethylcellulose ("CMC"), carboxymethylhydroxyethylcellulose ("CMHEC"), carboxymethyhydroxypropylcellulose ("CMHPC"), carboxymethylguar ("CMG"), carboxymethylated locust bean gum, carboxymethylstarch, and the like, and their alkali metal salts or ammonium salts. The preferred carboxyl-containing polymers are CMC and CMG.

Carboxymethylated polysaccharides are available with various degrees of substitution (D.S.), defined as the average number of (carboxymethyl) substituents per anhydroglucose unit in the polysaccharide. Carboxymethylcellulose (CMC) is operable for use in the invention between D.S. about 0.4 (below which it is insoluble) to about 3. The range D.S. about 0.6 to about 1.5 is preferred; that of about 0.7 to about 1.2 is more preferred. Carboxymethylguar (CMG) between D.S. about 0.05 and about 2.0 is operable; preferred is the range about 0.1 to about 1.0, and more preferred is the range about 0.2 to about 0.5.

The polymers in (B) also include anionic polymers of acrylamide. These can be made by hydrolysis of an acrylamide polymer or copolymer by means known to the art, or by copolymerizing acrylamide with acrylic acid or sodium acrylate and optionally another monomer under radical initiation, again by means known to the art. Also operable are poly(acrylic acid) or its salts such as sodium polyacrylate or ammonium polyacrylate. Other operable polymers in this group (B) are poly(acrylic acid) and its salts, and poly(sodium acrylate).

Anionic polyacrylamides are available in various molecular weight ranges, and with mole fractions of acrylic acid or acrylate salt per units between about 5 and about 70 mole percent. For convenience, those with weight-average molecular weights (Mw) below about 1 million are preferred. One suitable example is a polymer named Accostrength® 86, produced by the American Cyanamid Company.

Preferred (B) polymers are those available commercially, having carboxyl (or carboxylate salt) contents of about 0.5 to about 14 milliequivalents per gram. CMC is most preferred of all the (B) polymers.

Third Ingredient (C)

The substantially non-thermosetting resins (C) are made from poly(tertiary-amino)amides that are included among the polyaminoamide polymers used as precursors of the wet-strength resins of Subgroup (A1) of Ingredient (A).

Those precursors of the resins (C) are derived from an acid moiety and a polyamine, and have repeat units of the general structure:

$$-[-CO-A-CO-NH-[(CH_2)_m-N(R')-]_m-(CH_2)_m-NH-]-$$

The acid moieties, —[—CO—A—CO—]—, can use the same acids as those of Subgroup (A1): dicarboxylic acids of 2 to about 10 carbon atoms, their functional derivatives such as esters, amides, and acyl halides; also carbonate esters, urea, or carbonyl halides, etc.

In the amine moieties, $-NH-[(CH_2)_m-N(R')-]_p-(CH_2)_m-NH-]-$, m is between 2 and 6, inclusive, p will be between 1 and about 4, and R' is an alkyl group of between 1 and 4 carbon atoms. Alternatively, when p=2, the two R' groups may together be a $-CH_2CH_2-$ group. Usable examples include those with m=2, p=1, and R'=methyl; m=3, p=1, R'=methyl; m=6, p=1, R'=methyl; m=3, p=2, R'=methyl, m=3, p=2, R'=ethyl; m=3, p=1, R'=n-propyl.

The poly(tertiary amino)amide precursors of the resins can be made by making the acid component react in either of two ways:

(C1) either with a polyamine already possessing the tertiary amino groups, and having the structure:

$$H_2N-(CH_2)_m-N(R')-(CH_2)_m-NH_2$$

in which m, p, and R' have the values as above, or, (C2) with a polyalkylenepolyamine with two primary amine groups and the remainder secondary, having the structure:

$$H_2N-[(CH_2)_m-NH]_p-(CH_2)_m-NH_2$$

in which m and p have the values as above, followed by alkylation of the resulting poly(secondary aminoamide):

$$\dagger CO-A-CO-NH-[(CH_2)_m-NH)]_p-(CH_2)_m-NH\dagger$$

$$\Big\downarrow \text{alkylate}$$

$$\dagger CO-A-CO-NH-[(CH_2)_m-N(R')]_p-(CH_2)_m-NH\dagger.$$

Further details regarding the poly(tertiary-amino)amides from which the substantially non-thermosetting resins (C) are made, either by (C1) (with a polyamine already possessing the tertiary amino groups) or by (C2) (with a polyalkylenepolyamine with two primary amine groups and the remainder secondary) are set out below, and reference is also made to the description of the precursors of the wet-strength resins of Subgroup (A1) of Ingredient (A).

The poly(tertiary aminoamide) made by either route (C1) or (C2), is then reacted with epichlorohydrin in aqueous solution. The tertiary amine groups will be quaternized by reaction with the epichlorohydrin, and crosslinking will occur to build the molecular weight of the resin (as shown by increased viscosity of its solution). The amount of epichlorohydrin is such that substantial crosslinking can occur, building enough molecular weight that the resin will be substantive to pulp in wet-end addition. However, the amount of epichlorohydrin should also be limited, so as to limit the amount of wet strength the resin could impart in its own right after wet-end addition. It is desirable to have low enough wet-strength efficiency that it would take at least five times as much of component (C) as of component (A), to equal a given level of wet tensile strength in paper. To make this estimate requires developing a dose-response curve at multiple levels of addition. A simpler criterion is that at equal dose levels, component (C) should impart less than half as much wet strength as resin (A).

In the reaction of poly(tertiary aminoamide) with epichlorohydrin, the amount of epichlorohydrin will be between about 0.05 and about 0.35 mole per formula equivalent of tertiary amine in the polymer precursor; in version (C2), after alkylation. It is preferred to use between about 0.10 and about 0.30 mole epichlorohydrin per equivalent of tertiary amine. Within this range, the amount needed with an particular poly(tertiary aminoamide), as well as the conditions of temperature and the overall concentration of reaction solids, can be determined readily by experiment.

ILLUSTRATIVE POLYMERS OF GROUP (A), (B), AND (C) RESIN INGREDIENTS

Resin 1

Polyaminoamide-epihalohydrin resin (Group A1), available from Hercules Incorporated as Kymene® 557, well known from U.S. Pat. No. 3,951,921, may be prepared as follows.

A stirred mixture of 200 parts of diethylenetriamine and 290 parts of adipic acid is heated to 170°-175° C. for 1.5 hours with evolution of water, cooled to 140° C. and diluted to 50% solids with about 400 parts of water. The resulting aminopolyamide has a reduced specific viscosity (RSV)=0.16 (defined as $\eta sp/C$ in 1 molar aqueous $NH_4Cl$ at 25° C. at C=2 g/100 ml), 100 parts of the 50% solids diethylenetriamine-adipic acid polyamide solution is diluted with 300 parts of water, heated to 40° C., treated with 27.5 parts of epichlorohydrin, and heated with stirring for about 1 hour at 75° C., until the Gardner-Holdt viscosity rises to a value of E (determined with a sample cooled to 25° C.). The resin is then diluted with 302.5 parts of water and the pH is adjusted to 4.6 with concentrated sulfuric acid. A stabilized resin solution containing about 10% solids is obtained.

Resin 2

Polyaminoamide-epihalohydrin resin (Group A1), available from Hercules Incorporated as Kymene® 557H, also well known from U.S. Pat. No. 4,240,995, may be prepared as follows.

A cationic, water-soluble, nitrogen-containing polymer is prepared from diethylenetriamine, adipic acid and epichlorohydrin. Diethylenetriamine in the amount of 0.97 mole is added to a reaction vessel equipped with a mechanical stirrer, a thermometer and a reflux condenser. There then is gradually added to the reaction vessel one mole of adipic acid with stirring. After the acid had dissolved in the amine, the reaction mixture is heated to 170°-175° C. and held at that temperature for one and one-half hours, at which time the reaction mixture becomes very viscous. The reaction mixture then is cooled to 140° C., and sufficient water is added to provide the resulting polyamide solution with a solids content of about 50%. A sample of the polyamide isolated from this solution has a reduced specific viscosity of 0.155 deciliters per gram when measured at a concentration of two percent in a one molar aqueous solution of ammonium chloride. The polyamide solution is diluted to 13.5% solids and heated to 40° C., and epichlorohydrin is slowly added in an amount corresponding to 1.32 moles per mole of secondary amide in the polyamide. The reaction mixture then is heated at a temperature between 70° and 75° C. until it attains a Gardner viscosity of E-F. Sufficient water next is added to provide a solids content of about 12.5%, and the solution cooled to 25° C. The pH of the solution then is adjusted to 4.7° with concentrated sulfuric acid. The final product contained 12.5% solids and had a Gardner viscosity of B-C.

Resin 3

Polyaminopolyamide-epihalohydrin resin (Group C), available from Hercules Incorporated as Crepetrol® 190 (12.5% standard grade), is also well known from Canadian Patent 979,579. It may be prepared as follows.

Diethylenetriamine, 100 parts, and water, 50 parts, are placed in a reaction vessel equipped with a motor-driven stirrer, thermometer and condenser. To this is added 146 parts adipic acid. After the acid has dissolved in the diethylenetriamine, the resulting solution is heated and maintained at a temperature of from about 170° C. to 175° C. for 1½ hours. The reaction mass is cooled to room temperature and is diluted with water to a solids content of about 75%. To 50 parts of a 50% solids solution of the above polyaminopolyamide which has a reduced specific viscosity=0.155 (=$\eta sp/C$ at C=2 g/100-ml, in 1M $NH_4Cl$ at 25° C.) are added 13.8 parts 88% formic acid and 10.5 parts 37% formaldehyde. The resulting mixture is heated slowly to reflux, boiled under reflux for 1 hour, then cooled, diluted with 45 parts water, and adjusted to about pH 8.5 with 10N NaOH. To this reaction mass is added 2.7 parts epichlorohydrin. The resulting mass is heated at 60°-65° C. for 1.1 hours, while the viscosity of the mixture increases to Gardner-Holdt reading "M" (of a sample cooled to 25° C.). The solution after dilution with 246 g water and adjustment to pH 4 with $H_2SO_4$, has a Brookfield viscosity of 29 centipoises at 25° C. (Brookfield Model LVF Viscometer No. 1 spindle, 60 rpm).

Resin 4

A polyaminopolyamide-epihalohydrin resin (Group C), but representing a 25% solids version of Resin 3 may be prepared as follows.

To a solution of 600 g (solids basis) of a 1:1 adipic diethylenetriamine polyamide in 1679 g water is added 332.4 g of 90% formic acid with cooling, then 252 g of aqueous 37% formaldehyde. The mixture is heated slowly to boiling and heated under reflux for 1 hour, then cooled and treated with 464.7 g of 30% sodium hydroxide. To the stirred solution is then added 63.8 g epichlorohydrin, and the mixture is heated to 60°-67° C. until the Gardner-Holdt viscosity (of a sample at 25° C.) had reached "L". The resin solution is then diluted with 824 g water, acidified with 140 g concentrated (96%) sulfuric acid, and cooled to give a solution of about 25.2% solids.

Resin 5

The reaction product of adipic acid or an adipic ester of methylbis(3-aminopropyl)amine, (MBAPA) and epihalohydrin a (low epi resin of Group C) may be prepared as follows.

A solution of 51.1 g (solids basis) of a 1:1 adipic acid methylbis(3-aminopropyl)amine polyamide in 125.1 g water is treated with 3.12 g concentrated sulfuric acid, then with 4.6 g epichlorohydrin. The mixture is heated at 55°-56° C. with stirring until the Gardner-Holdt viscosity (of a sample at 25° C.) is "H". The resin is then quenched with 40 g water and 3.64 g concentrated sulfuric acid to give a resin solution at about 27.3% solids. A 60 g sample of this solution is further diluted with 71 g water to give a sample at about 12.5% solids for evaluation.

Resin 6

A reaction product of dimethylamine and ethylenediamine with epihalohydrin resin, available from Hercules Incorporated as Reten® 201, may be prepared as follows.

To a solution of 85.5 g dimethylamine and 6.0 g ethylenediamine in 283.7 g water at 45° C. is added 185.1 g epichlorohydrin during 3 hours, while maintaining the temperature at 45°-50° C. The mixture is then increased to 90° C. and held there for 30 minutes. Twelve grams of 50% sodium hydroxide, then 4.7 g epichlorohydrin are added. The mixture is stirred at 90° C. for 40 minutes, treated with 2.4 g additional epichlorohydrin and allowed to react at 90° C. for 2.6 hours. The solution is cooled and diluted with 29.6 g water to provide a resin solution of about 50% solids and a Brookfield viscosity of about 170 cp.

Resin 7

The reaction product of N,N-dimethyl-1,3-propanediamine and epihalohydrin. It may be prepared as follows.

To a solution of 51.1 parts of N,N-dimethyl-1,3-propanediamine in 146 parts of water, 46.26 parts of epichlorohydrin is added with cooling. The mixture is held between 55° and 60° C. for 15 minutes, during which it reaches a Gardner-Holdt viscosity of about L (sample cooled to 25° C.). Dilution water (81.1 parts) is added, and the mixture is reheated at 55°-65° C. for 65 minutes.

Additional epichlorhydrin (2.3 parts) is added. The viscosity rose rapidly, and the mixture is diluted with about 975 parts of water. The solution contained 1.16% nitrogen (by Antek analyzer), corresponding to calculated active polymer content of 8.0%. The solution has a Brookfield viscosity of about 76 cp. (no. 1 spindle, 30 rpm).

Resin 8

A poly(methyldiallylamine)-epihalohydrin resin from Group A3, available from Hercules Incorporated as Kymene® 2064, and well known from U.S. Pat. No. 3,966,694, may be prepared as follows.

A solution of 69.1 parts of methyldiallylamine and 197 parts of 20° Be hydrochloric acid in 111.7 parts of demineralized water is sparged with nitrogen to remove air, then treated with 0.55 part of tertiary butyl hydroperoxide and a solution of 0.0036 part of ferrous sulfate in 0.5 part of water. The resulting solution is allowed to polymerized at 60°-69° C. for 24 hours, to give a polymer solution containing about 52.1% solids, with an RSV of 0.22. 122 parts of the above solution is adjusted to pH 8.5 by the addition of 95 parts of 3.8% sodium hydroxide and then diluted with 211 parts of water, and combined with 60 parts of epichlorohydrin. The mixture is heated at 45°-55° C. for 1.35 hours, until the Gardner-Holdt viscosity of a sample cooled to 25° C. reaches B+. The resulting solution is acidified with 25 parts of 20° Be hydrochloric acid and heated at 60° C. until the pH becomes constant at 2.0. The resulting resin solution has a solids content of 20.8% and a Brookfield viscosity=77 cp. (measured using a Brookfield Model LVF Viscometer, No. 1 spindle at 60 r.p.m. with guard).

25 parts of 9.58% solids solution of the resin described above is combined with a solution of 1.62 parts of 10N sodium hydroxide in 11.25 parts of water and aged 0.5 hour. The resulting solution is diluted with 25 parts of water, combined with 12.1 parts of concentrated (28%) aqueous ammonia, and allowed to react for one month at 25° C.

Resin 9

The sodium salt of carboxymethylcellulose, DS=0.7, an anionic polymer of Group B. Commercially identified as CMC-7M and available from Aqualon Company, Wilmington, Del.

Resin 10

Carboxymethylguar with a DS of about 0.3, an anionic polymer of Group B; well known from U.S. Pat. No. 4,970,078. A carboxymethylguar having a degree of substitution of about 0.3 may be prepared as follows.

Guar, available from Aqualon Company, Wilmington, Del. as Supercol® guar gum, is reacted with monochloroacetic acid under caustic conditions to provide a degree of substitution of about 0.3. The carboxymethyl-guar is recovered, washed, and dried to produce a white powder.

Resin 11

Acrylamide-sodium acrylate copolymer (Group B). Its perparation is as follows.

To a reactor are charged 16 parts of deionized water and 0.0353 part cupric sulfate. One hundred parts of 98% sulfuric acid is added during 1 hour with agitation, and the mixture is heated to 80° C.

Over approximately 2.5 hr, 53 parts of acrylonitrile are added while the temperature is maintained at 80° C. After the addition is complete, the mixture is heated for 1 hr at 90° C., diluted with 9 parts deionized water, stirred 15 minutes, then diluted with 467 parts of deionized water. The solution is cooled to 30° C., neutralized to about pH 3.2 with about 120 parts of 28% aqueous ammonia, and cooled to 25° C. About 6.3 parts of acrylic acid is added.

Over a 20 minute period, 3.34 parts of 10% sodium bisulfite in water and 3.23 parts of a 10% solution of t-butyl hydroperoxide in 1:1 acetone:water are added, and the solution is agitated for 1 hour more. The solution is then adjusted to pH 6.0 with 28% aqueous ammonia, treated with 0.71 part sodium bisulfite, stirred for 1 hr, and packaged to provide a solution containing about 10% polymer solids.

Operating Conditions

The thermosetting wet-strength resin of group (A), the anionic polymer of group (B), and the nonthermosetting cationic polyamide resin of group (C), are added to the stock at or ahead of the wet end of the paper machine. The pulps may be softwood or hardwood, and made by conventional pulping processes: kraft, sulfite, alkali, thermo-mechanical (TMP), chemitheromomechanical (CTMP), etc. Blends of two or more pulps may be used. Preferably, a bleached hardwood/softwood kraft pulp blend, or a CTMP/hardwood kraft/softwood kraft blend, is used.

The wet-strength resin and the non-thermosetting cationic resin may be added in either order, and the anionic polymer may be added before, between, or after them, at convenient locations on the paper machine. Preferably, the cationic wet-strength resin and the nonthermosetting resin is added first, before the anionic polymer, as in most of the examples.

The pH of the system will be in a range customary for the use of the wet-strength resins in group (A), between about 4.5 and about 10, and preferably between about 6 and about 9. Water temperatures may be between about 2° and about 80° C., preferably between about 10° and about 60° C.

It is known, for instance from U.S. Pat. Nos. 3,058,873 and 3,049,469, and in the Proceedings of the 1983 TAPPI Papermakers Conference, Portland Oreg. pp. 191–195, that the neutral or alkaline-curing wet-strength resins of group (A) become more effective in imparting wet strength and increasing dry strength, if they are used in conjunction with a water-soluble carboxyl-bearing polymer as referred to above in group (B), such as CMC.

The wet- and dry-strength responses increase with the ratio of anionic polymer to cationic resin, up to a maximum. Above this ratio, the complex between the resin and the polymer assumes a net negative charge, so that it is less effectively retained on the anionic surface of the pulp fibers. The optimum ratio can be determined readily by experiment. It will depend on the content of carboxylate groups in the anionic polymer, the cationic charge density of the thermosetting wet-strength resin, the content of carboxylate or other anionic groups on the pulp, and the water hardness. By way of illustration: the diethylenetriamine-adipic acid polyamide-epichlorohydrin wet-strength resin of Resin A, below, used with a carboxymethylcellulose sodium salt (CMC) of D.S. about 0.7, in a typical bleached kraft pulp in water of about 100 ppm hardness, will be most effective at a weight ratio of about 0.5 to about 1.0 part of CMC by weight per part of wet-strength resin solids.

In an unfamiliar system of pulp and water, it is convenient to use about 0.5 part of CMC per part of resin solids as a starting point for experimentation. For anionic polymers with lower or higher carboxyl contents, or resins with higher or lower charge densities, the optimum weight ratio of polyanion/cationic resin will go up or down, and can be determined by experiment according to conventional principles.

It is also known, for instance from U.S. Pat. Nos. 3,332,834, 3,790,514, 3,660,338, and 3,667,888, that combinations of nonthermosetting cationic polymers with anionic polymers of group (B) will increase the dry strength of paper, while imparting little or no wet strength.

With these combinations, it is also known, for instance from Reynolds, Ch. 6 in "Dry Strength Additives", W. F. Reynolds, ed., TAPPI Press, Atlanta, 1980; FIGS. 6–9, p. 141. that the improvement in dry strength rises to a maximum, then declines as the ratio of anionic polymer to cationic polymer increases.

As with the wet-strength resins above, the optimum weight ratio will conventionally depend on the carboxyl content of the anionic polymer, the cationic charge density of the non-thermosetting resin, the carboxyl content of the pulp, and the water hardness, and can be readily determined by experiment.

By way of illustration: for combinations of the resin of Resin 3, above, with Resin 9 (CMC of D.S. 0.7), a ratio of about 0.5 part CMC per part resin solids by weight is a convenient starting point for optimizing the dosage.

With the combinations of wet-strength resin Group (A), anionic polymer Group (B), and nonthermosetting cationic resin Group (C) of this invention, the optimum amount of Group (C) resin will depend on the particular choice of wet-strength resin (A) and the Group (C) resin. By way of illustration: with the wet-strength resin of Resin 1 and the nonthermosetting resin of Resin 3 below, good results are obtained with about 0.25 to about 1 part of Resin 3 solids per part of Resin 1 wet-strength resin solids, with about 0.3 to about 0.5 part being preferred. Higher amounts of nonthermosetting resin can be used but may represent diminishing returns.

The optimum ratio of Group (B) anionic polymer to the other materials will depend on the choices of anionic Group (B) polymer, Group (A) wet-strength resin and nonthermosetting Group (C) resin. As a general rule, the amount will be about equal to the sum of the optimum amount for the chosen amount of wet-strength resin by itself, and the optimum amount for the chosen amount of nonthermosetting resin by itself. Thus, by way of illustration: if it is desired to improve the absorbency of paper using a combination of 1.0 part of the resin of Resin 1 and 0.5 part of CMG of Resin 10, then a good starting point for further experimentation is 1.0 part of wet-strength resin of Resin 1, 0.25 to 0.5 part of the non-thermosetting resin of Resin 3, and 0.625 to 0.75 part of the CMG of Resin 10.

Combinations of a Group (A) wet-strength resin and Group (B) anionic polymer, as well as Group (C) nonthermosetting resin, increase dry strength. Thus, if dry and wet strength are satisfactory in the paper with a given combination of (A) and (C), adding (B) and additional (C) as illustrated above to improve absorbency may give more dry strength and/or wet strength than desired.

In order to bring the dry and/or wet strength back into the levels specified according to the invention, the amount of Group (A) resin can be reduced when anionic Group (B) polymer and Group (C) resin are added, i.e., effectively replacing it in part, rather than augmenting it, while maintaining the preferred ratio of anionic polymer to cationic resins for the particular resin in question. By way of example, the strength performance of 1 part of Resin 1 might be matched, and its absorbency greatly improved, by using instead about 0.6 part of Resin 1, 0.45 parts of Resin 10, and about 0.3 part of Resin 3. With combinations of other wet-strength resins, anionic polymers, and nonthermosetting cationic polymers, the optimum amounts for improving absorbency while maintaining desired strength specifications can be readily determined by conventional experiment.

Resin Precursors

The polyaminoamides from which the thermosetting wet-strength resins of subgroup (A1) are made from dicarboxylic acids of 2 to about 10 carbon atoms, including saturated and unsaturated aliphatic diacids, alicyclic acids, and aromatic acids; their esters, amides, or acyl halides; dialkyl carbonates, urea, or carbonyl halides; or mixtures of two or more of these ingredients. The amine components of the polyaminoamides are polyalkylenepolyamines of structure:

$$H_2N-[(CH_2)_m-N(R)-]_n-(CH_2)_m-NH_2,$$

in which m is between 2 and 6, n is between 1 and about 5, and R is chosen from among hydrogen and alkyl groups of 1 to 4 carbon atoms. Mixtures of two or more amines may be used. Diamines (above formula, n=1) may be used as part of the amine furnish, up to about two-thirds of the amine component on a molar basis.

The polyamides are made by means known to the art: by heating one or more of the acid components (and/or their functional derivatives) with one or more or the amine components, with evolution of water or lower alcohol (or ammonia, in cases where urea is used). In typical polyamides used to make the resins of subgroup (A1), the mole ratio of polyamine/dicarboxylic acid is between about 0.8 and about 1.4 to 1.

Examples of dicarboxylic acids from which the polyaminoamides are derived include oxalic, malonic, succinic, glutaric, adipic, pimelic, suberic, azelaic, sebacic, maleic, fumaric, itaconic, phthalic, isophthalic, and terephthalic. Preferred, because of their availability and economy, are oxalic, malonic, succinic, glutaric, adipic, azelaic, sebacic, maleic, fumaric, and itaconic acids; or their lower alkyl esters or ammonia amides. Among polyamine moieties, preferred sources are diethylenetriamine, triethylenetetramine, tetraethylenepentamine, pentaethylenehexamine, iminobispropylamine, N,N-bis(3-aminopropyl)-1,3-propanediamine, methylbis(3-aminopropyl)-amine, bis(3-aminopropyl)piperazine, and the like. As above, combinations of two or more acid components can be used, such as (by way of non-limiting example) oxalic acid or its esters with adipic acid or its esters, or urea with glutaric acid or adipic acid or a corresponding ester.

The thermosetting polyamine-epichlorohydrin wet-strength resins of subgroup (A2) are made are alkylenediamines and polyalkylene-polyamines of structure:

$$H_2N-[(CH_2)_m-N(R)-]_n-(CH_2)_m-NH_2,$$

in which m is between 2 and 6, n is between 1 and about 5, and R is chosen from among hydrogen and alkyl groups of 1 to 4 carbon atoms. Mixtures of two or more amines may be used. "Compound" polyamines can be used, that are made in a previous step in which two moles of a polyamine are coupled by one molar equivalent of a bifunctional alkylating agent such as (by way of example only) a 1,2-dihaloethane, a 1,3-dihalopropane, epichlorohydrin, or a diepoxide. Preferred polyamines include diethylenetriamine, triethylenetetramine, tetraethylenepentamine, pentaethylenehexamine, iminobispropylamine,N,N-bis(3-aminopropyl)-1,3-propanediamine, methylbis(3-aminopropyl)amine, bis(3-aminopropyl)piperazine, hexamethylenediamine, bishexamethylenetriamine, 2-methyl-1,5-pentanediamine, and the like. The polyamine is reacted with epichlorohydrin in aqueous solution, using ratios of about 0.5 to about 2 moles of epichlorohydrin per equivalent of amine nitrogen in the diamine or polyamine component. Reaction temperatures are usually between about 20° and about 80° C., and concentrations of total reactants in the aqueous medium are between about 10% and about 70% by weight. Suitable conditions for a given combination of diamine and/or polyamine with epichlorohydrin can be determined readily by experiment.

The amine polymer-epichlorohydrin wet-strength resins of subgroup (A3) are made from polymers of diallylamines of structure $$CH_2=CHCH_2-N(R)-CH_2CH=CH2$$

in which R=hydrogen or an alkyl group of between 1 and 4 carbon atoms. Mixtures of two or more such amines can be used as components of the polymer, as can combinations of one or more diallylamines shown above with other monomers such as acrylamide, N-alkylated acrylamides, acrylate esters, methacrylate esters, dialkylaminoalkyl acrylate and methacrylate esters, etc., that are polymerizable with radical initiators.

The poly(tertiary-amino)amide precursors of the substantially non-thermosetting resins of Group (C) are made either by (C1) (with a polyamine already possessing the tertiary amino groups) or by (C2) (with a polyalkylenepolyamine with two primary amine groups and the remainder secondary).

In version (C1), an acid component as defined above is heated with a polyamine containing two primary amine groups and at least one tertiary amine group. Useful examples are methylbis-(3-aminopropyl)amine, ethylbis(3-aminopropyl)amine, n-propylbis(3-aminopropyl)-amine, N,N'-bis(3-aminopropyl)-N, N'-dimethyl-1, 3-propanediamine, and bis(3-aminopropyl)piperazine. Preferred examples include poly-(tertiary aminoamides) derived from methylbis(3-aminopropyl)amine with adipic acid, dimethyl adipate, glutaric acid, dimethyl glutarate, or itaconic acid.

In version (C2), an acid component as defined above is heated with a polyamine containing two primary amine groups and at least one secondary amine group. These include the polyethylenepolyamines, $H_2N-[(CH_2)_m-NH]_n-(CH_2)_m-NH_2$ in which m is 2 and n is between 1 and about 5, and the poly(trimethyleneamines), in which m=3 and n is between 1 and about 5. Usable examples include combinations of an acid component as defined above with diethylenetriamine, triethylenetetramine, tetraethylenepentamine, iminobispropylamine, and N,N'-bis(3-aminopropyl)-1,3-propanediamine.

The resulting poly(secondary aminoamide) is then alkylated to convert the secondary amine groups substantially completely to tertiary amine groups, bearing alkyl groups between 1 and 4 carbon atoms.

Useful examples of alkylation reactions include the reaction with alkyl halides, dialkyl sulfates, alkyl methanesulfonates, alkyl benzenesulfonates, alkyl p-toluenesulfonates, or reductive alkylation with formaldehyde and formic acid.

In version (C2), preferred examples are combinations of one or more of these acids: glutaric, adipic, or itaconic (or their corresponding methyl or ethyl esters), with one or both of diethylenetriamine or triethylenetetramine (more preferably diethylenetriamine), to give a poly(secondary aminoamide) that would then be methylated: either by treatment with a methyl halide, or more preferably by reductive alkylation with formaldehyde and formic acid.

The poly(tertiary aminoamide) made by either route (C1) or (C2), is then reacted with a limited amount of epichlorohydrin in aqueous solution, as already described.

The following Examples illustrate the invention.

EXAMPLES R01 THROUGH R12 (INCLUDING CONTROL EXAMPLES)

A 50/50 blend of bleached hardwood kraft pulp and bleached softwood kraft pulp was refined to approximately 500 mL Canadian Standard freeness in water containing 100 ppm calcium hardness and 50 ppm bicarbonate alkalinity. The pulp, untreated with resin or treated with one or more of Resins 1, 8, 9 and 11, was cast into handsheets of basis weight approximately 65 g/m$^2$, on a Noble-Wood handsheet machine. The resins were added to the stock at approximately 0.28% consistency in the proportioner, in the following order: Group (A) wet-strength resin (Resin 1 or 8), Group (C) nonthermosetting cationic resin (Resin 3), and Group (B) anionic polymer (Resin 9 or 11).

After aging 1 week at 23° C. and 50% relative humidity, the test sheets were tested for dry and wet tensile strengths by the tensile tests (TAPPI method T494-om88), and for absorbency (rate of water drop absorption) by the TAPPI water drop test (TAPPI test method T432), which records the times for absorption of a 0.1 mL drop of distilled water. (These tests were used to record the results of the other examples also).

R06 also outperforms Kymene® alone on an equal resin (R03) or equal-total additive basis (R04), but with no significant improvement of absorbency.

Examples R07 and R08 are illustrative examples of this invention, using Kymene® 557 resin, CMC-7M, and Crepetrol® 190 nonthermosetting cationic resin. R07 shows greater dry and wet strength, and much faster absorbency, than Kymene® 557 resin alone at an equal Kymene® resin level (R02), equal total cationic resin level (R03), or equal total additive level (R04). It also shows higher wet and dry strength and faster absorbency than Kymene® 557 resin plus CMC at an equal Kymene® resin level (R05). Dry strength and absorbency are also better, and wet strength nearly as high, as given by Kymene® 557 resin plus CMC at an equal total cationic resin level (R06).

Examples R08 and 09 demonstrates that an anionic polyacrylamide (Resin 11) may be used in the invention as the Group (B) anionic polymer. The material was a 92:8 acrylamide:acrylic acid copolymer, in which the acrylamide was made in-situ by hydrolyzing acrylonitrile. The three-part mixture with polyacrylamide gave a somewhat slower absorbency value, with approximately equal wet tensile strength, than the mixture with CMC, but it still improves the absorbency substantially.

Examples R11 and 12 show the successful application to poly-(methyldiallylamine)-epichlorohydrin wet-strength resin (Resin 8). Note that R11 and R03 show that the resin 8-CMC system is inherently less absorbent

TABLE R

| Examples | Resin (A) | Addition % of Pulp | Anionic Polymer (B) | Addition % of Pulp | Resin (C) | Addition % of Pulp | Breaking Length, km Dry | Breaking Length, km Wet | Absorption Time Sec.* |
|---|---|---|---|---|---|---|---|---|---|
| R01 | None | — | None | — | None | — | 4.83 | 0.15 | 45 |
| R02 | 1 | 0.45 | None | — | None | — | 5.45 | 0.92 | 130 |
| R03 | 1 | 0.67 | None | — | None | — | 5.76 | 1.05 | 149 |
| R04 | 1 | 1.0 | None | — | None | — | 5.73 | 1.18 | 140 |
| R05 | 1 | 0.45 | 9 | 0.22 | None | — | 6.42 | 1.23 | 116 |
| R06 | 1 | 0.67 | 9 | 0.33 | None | — | 6.78 | 1.45 | 139 |
| R07 | 1 | 0.45 | 9 | 0.33 | 3 | 0.22 | 6.99 | 1.36 | 65 |
| R08 | 1 | 0.67 | 9 | 0.5 | 3 | 0.33 | 6.94 | 1.48 | 55 |
| R09 | 1 | 0.3 | 11 | 0.25 | None | — | 5.87 | 1.07 | 177 |
| R10 | 1 | 0.3 | 11 | 0.37 | 3 | 0.15 | 6.56 | 1.09 | 84 |
| R11 | 8 | 0.3 | 9 | 0.15 | None | — | 6.14 | 1.05 | 208 |
| R12 | 8 | 0.3 | 9 | 0.22 | 3 | 0.15 | 6.01 | 1.15 | 109 |

*Tested according to the TAPPI water drop test (TAPPI test method T432).

Examples R01 through R12 illustrate the effect of the preferred resins of the invention: Group (A) wet-strength Resins 1 (Kymene® 557) and 8 (Kymene® 2064), Group (B) anionic polymer Resin 9, CMC-7M, and Group (C) non-thermosetting cationic Resin 3, Crepetrol® 190.

The Control Example R01 product is "waterleaf": it is resin-free and as absorbent as possible without introducing wetting agents or surfactants that would degrade its dry strength.

Control Examples R02, 03, and 04 show the effect of a Group (A) Resin (Kymene® 557) alone, at levels that can be compared with later examples on either an equal Kymene® wet strength resin basis, an equal total Groups (A) and (B) cationic resin basis, or an equal total resin additive basis.

Examples R05 and R06 use Kymene® 557 resin plus CMC, at an approximately optimum ratio. R05, with a Group (B) anionic polymer (CMC) outperforms Kymene® resin alone on either an equal Kymene® resin basis (Example R02) or an equal total resin additive basis (Example R03), but with only slightly faster absorbency (116 seconds). At a higher set of levels, Example than Resin 1 (Kymene® 557) alone at equal wet strength. R11 vs. R05 shows that it is less absorbent than Kymene® 557+CMC, despite its lower wet strength. Nevertheless, (in R12) the incorporation of Resin 3 improves absorbency substantially (as well as wet strength). The results are recorded in Table R.

EXAMPLES S01 THROUGH S05 (INCLUDING CONTROL EXAMPLES)

A 50/50 blend of bleached hardwood kraft pulp and bleached softwood kraft pulp was refined to approximately 500 mL Canadian Standard freeness in water containing 100 ppm calcium hardness and 50 ppm bicarbonate alkalinity. Pulp, treated with additives, was cast into handsheets of basis weight approximately 65 g/m$^2$, on a Noble-Wood handsheet machine. In Examples S02 and S03, Group (A) wet-strength resin (with Group (B) nonthermosetting cationic resin, where used) was added to stock at 2.5% consistency. Anionic polymer, when used, was added at the proportioner, at 0.28% consistency. In Examples S04 and S05, the order of addition was reversed: anionic polymer was added to the thick stock at 2.5% consistency, and cationic polymers were added to the proportioner at 0.28% consistency.)

After aging 1 week at 23° C. and 50% relative humidity, the test sheets were tested for dry and wet tensile strengths, and for absorbency by the TAPPI water drop test (TAPPI test method T432), which records the times for absorption of a 0.1 mL drop of distilled water. The results are recorded in Table S.

TABLE S

| Examples | Resin (A) | Addition % of Pulp | Anionic Polymer (B) | Addition % of Pulp | Resin (C) | Addition % of Pulp | Breaking Length, km Dry | Breaking Length, km Wet | Absorption Time Sec.* |
|---|---|---|---|---|---|---|---|---|---|
| S01 | None | — | None | — | None | — | 5.10 | 0.13 | 43 |
| S02 | 1 | 0.5 | None | — | None | — | 5.54 | 0.83 | 167 |
| S03 | 1 | 0.25 | 9 | 0.17 | 3 | 0.08 | 6.17 | 0.87 | 57 |
| S04 | 1 | 0.5 | None | — | None | — | 5.65 | 0.81 | 146 |
| S05 | 1 | 0.25 | 9 | 0.17 | 3 | 0.08 | 5.32 | 0.84 | 47 |

*Tested according to the TAPPI water drop test (TAPPI test method T432).

Examples S01 through S05 deal with the order of addition of the components. The data show that absorbency is improved, relative to wet-strength resin alone, with approximately equal wet strength, whether the cationic resins are added to the stock before the anionic polymer (compare S03 with S02) or after it (compare S05 with S04).

Note that in S05, the absorption is almost as fast as that of waterleaf, S01. However, there is no indication in the available data that one order of addition is preferred.

EXAMPLES T01 THROUGH T12 (INCLUDING CONTROL EXAMPLES)

A 50/50 blend of bleached hardwood kraft pulp and bleached softwood kraft pulp was refined to approximately 500 mL Canadian Standard freeness in water containing 100 ppm calcium hardness and 50 ppm bicarbonate alkalinity. Pulp, treated with additives, was cast into handsheets of basis weight approximately 65 g/m$^2$, on a Noble-Wood handsheet machine. The additives were added to the stock at approximately 0.28% consistency in the proportioner, in the order: wet-strength resin (Resin 2), non-reactive cationic resin (Resin 4), and anionic polymer (Resin 9 or 10).

After aging 2 weeks at 23° C. and 50% relative humidity, the test sheets were tested for dry and wet tensile strengths, and for absorbency (rate of water drop absorption) by the TAPPI water drop test (TAPPI test method T432). Results are the times for absorption of a 0.1 mL drop of distilled water. The results are recorded in Table T.

Examples T01 through T12 show the synergistic interaction of Group (A) wet strength resins, Group (B) anionic polymers, and Group (C) nonthermosetting resins. The latter (C) resins, alone or with anionic polymers (B), is not a wetting agent in the absence of a wet-strength resin (A).

Other examples show the generality of the anionic polymer; i.e., that carboxymethylguar (Resin 10) works as well as carboxymethylcellulose (Resin 9).

Example T01 is the waterleaf control. T02 shows the impairment of absorbency by wet-strength resin alone (95 vs. 36 seconds). T03 and T04 show the lesser, but still substantial, impairment of absorbency by combination of the wet-strength resin with either CMC or carboxymethylguar CMG, respectively. (Note that the CMC impaired absorbency less than the CMG.)

Examples T05 and T06 show combinations of the three materials that give greatly improved absorbency (matching waterleaf or very close to it), at levels chosen to give about the same wet strength as 0.5% wet-strength resin alone in Example T02). They also improve absorbency substantially over 0.3% wet-strength resin plus an optimum amount of anionic polymer (Examples T03 and T04), while imparting about the same wet strength.

Examples T11 and T12 of the invention show combinations of the three components that approximately match the wet strength of 0.5% Group (A) wet-strength resin plus an optimal amount of anionic polymer CMC or CMG (Examples T09 and T10) rather than Group (A) resin alone, as above. Note that among the controls, the resin-CMG paper product of Example T10 was less absorbent than the resin-CMC paper product of Example T09. However, the three-component mixture using either anionic polymer CMC or CMG (Examples T11 and T12) showed similar levels of dry and wet strength, and greatly improved absorbency.

TABLE T

| Examples | Resin (A) | Addition % of Pulp | Anionic Polymer (B) | Addition % of Pulp | Resin (C) | Addition % of Pulp | Breaking Length, km Dry | Breaking Length, km Wet | Absorption Time Sec.* |
|---|---|---|---|---|---|---|---|---|---|
| T01 | None | — | None | — | None | — | 4.84 | 0.13 | 36 |
| T02 | 2 | 0.5 | None | — | None | — | 5.69 | 1.04 | 95 |
| T03 | 2 | 0.3 | 9 | 0.15 | None | — | 6.29 | 1.10 | 68 |
| T04 | 2 | 0.3 | 10 | 0.35 | None | — | 6.01 | 1.12 | 87 |
| T05 | 2 | 0.25 | 9 | 0.225 | 4 | 0.20 | 6.32 | 1.06 | 36 |
| T06 | 2 | 0.25 | 10 | 0.525 | 4 | 0.20 | 6.54 | 1.16 | 39 |
| T07 | None | — | None | — | 4 | 0.50 | 4.79 | 0.30 | 32 |
| T08 | None | — | 10 | 0.35 | 4 | 0.30 | 5.11 | 0.26 | 36 |
| T09 | 2 | 0.50 | 9 | 0.25 | None | — | 6.90 | 1.32 | 78 |
| T10 | 2 | 0.50 | 10 | 0.6 | None | — | 6.95 | 1.36 | 118 |
| T11 | 2 | 0.40 | 9 | 0.40 | 4 | 0.40 | 6.81 | 1.28 | 27 |
| T12 | 2 | 0.40 | 10 | 0.90 | 4 | 0.40 | 6.74 | 1.31 | 40 |

*Tested according to the TAPPI water drop test (TAPPI test method T432).

EXAMPLES U01 THROUGH U24 (INCLUDING CONTROL EXAMPLES)

A 35/35/30 blend of bleached hardwood kraft/-bleached softwood kraft/softwood chemithermomechanical pulp was refined to approximately 500 mL Canadian Standard freeness in water containing 100 ppm calcium hardness and 50 ppm bicarbonate alkalinity. Pulp, treated with additives, was cast into handsheets of basis weight approximately 65 g/m$^2$, on a Noble-Wood handsheet machine. The additives were added to the stock at approximately 0.28% consistency in the proportioner, in the order: Group (A) wet-strength resin (Resin 2), nonthermosetting cationic resin (Resin 4, 5, 6, or 7), and anionic polymer (Resin 9 or 10).

After aging 4 weeks at 23° C. and 50% relative humidity, the test sheets were tested for dry and wet tensile strengths, and for absorbency (rate of water drop absorption) by the TAPPI water drop test (TAPPI test method T432). Results are the times for absorption of a 0.1 mL drop of distilled water. The results are recorded in Table U.

TABLE U

| Examples | Resin (A) | Addition % of Pulp | Anionic Polymer (B) | Addition % of Pulp | Resin (C) | Addition % of Pulp | Breaking Length, km Dry | Breaking Length, km Wet | Absorption Time Sec.* |
|---|---|---|---|---|---|---|---|---|---|
| U01 | None | — | None | — | None | — | 4.97 | 0.12 | 37 |
| U02 | 2 | 0.50 | None | — | None | — | 5.64 | 1.17 | 81 |
| U03 | 2 | 0.25 | 9 | 0.125 | None | — | 5.57 | 0.98 | 65 |
| U04 | 2 | 0.25 | 10 | 0.30 | None | — | 5.60 | 0.81 | 60 |
| U05 | 2 | 0.25 | 9 | 0.25 | 4 | 0.25 | 5.83 | 1.00 | 47 |
| U06 | 2 | 0.25 | 10 | 0.58 | 4 | 0.25 | 5.56 | 0.87 | 45 |
| U07 | 2 | 0.25 | 9 | 0.25 | 5 | 0.25 | 5.99 | 1.11 | 37 |
| U08 | 2 | 0.25 | 9 | 0.25 | 6 | 0.125 | 6.14 | 1.07 | 59 |
| U09 | 2 | 0.25 | 9 | 0.25 | 7 | 0.125 | 5.89 | 1.01 | 67 |
| U10 | 2 | 0.5 | 9 | 0.25 | None | — | 6.76 | 1.40 | 117 |
| U11 | 2 | 0.45 | 9 | 0.45 | 4 | 0.45 | 6.58 | 1.34 | 46 |
| U12 | 2 | 0.45 | 9 | 0.45 | 5 | 0.45 | 6.81 | 1.47 | 55 |
| U13 | 2 | 0.45 | 9 | 0.45 | 6 | 0.45 | 6.63 | 1.42 | 109 |
| U14 | 2 | 0.45 | 9 | 0.45 | 7 | 0.45 | 6.71 | 1.31 | 128 |
| U15 | 2 | 0.5 | 10 | 0.6 | None | — | 6.06 | 1.21 | 104 |
| U16 | 2 | 0.45 | 10 | 1.0 | 4 | 0.45 | 6.39 | 1.22 | 37 |
| U17 | None | — | None | — | 4 | 0.5 | 4.97 | 0.16 | 33 |
| U18 | None | — | None | — | 5 | 0.5 | 5.03 | 0.52 | 42 |
| U19 | None | — | None | — | 6 | 0.5 | 4.84 | 0.17 | 70 |
| U20 | None | — | None | — | 7 | 0.5 | 4.91 | 0.30 | 122 |
| U21 | None | — | 9 | 0.125 | 4 | 0.25 | 4.93 | 0.15 | 34 |
| U22 | None | — | 9 | 0.125 | 5 | 0.3 | 5.72 | 0.52 | 50 |
| U23 | None | — | 9 | 0.125 | 6 | 0.125 | 5.24 | 0.15 | 61 |
| U24 | None | — | 9 | 0.125 | 7 | 0.125 | 5.10 | 0.16 | 69 |

*Tested according to the TAPPI water drop test (TAPPI test method T432).

Examples U01 through U24 show operability in a different pulp furnish: one incorporating chemithermomechanical pulp (CTMP) with bleached kraft pulps. It also illustrates use of a nonthermosetting resin (group (C) component) based on a polyamide made from an amine having a tertiary amine group initially (Resin 5), rather than one in which a poly(secondary aminoamide) was post-methylated (Resins 3 and 4). It again demonstrates the synergism of the three components. Finally, it further delineates the invention, showing the uniqueness of Group (C) components based on polyamides.

Two more non-amide resins containing quaternary ammonium groups are shown to be detrimental to absorbency, with anionic Group (B) polymer and also as part of the three-part compositions of the invention and described in Table U.

Example U01 is a waterleaf (resin-free) control. U02, U03, and U04 are wet-strength comparators, respectively using Kymene® 557H resin (Resin 2) alone, Kymene® 557H resin+CMC, or Kymene® 557H resin+CMG.

Again, U05 vs. U03, and U06 vs. U04, show the substantially improved absorbency of the three-part systems of this invention, over wet-strength resin+anionic polymer at about equal wet-strength, and at equal wet-strength resin furnish. Comparing U04 (0.25 Resin 2+anionic Group (B) polymer) and U06 (0.25 Resin 2 and 0.25 Resin 4+anionic Group (B) polymer) with U02 (0.50 Resin 2 alone) makes the same point with respect to wet-strength resin alone and with anionic polymer at equal total cationic resin addition.

Resin U07 and U22 show the operability of a polyamide resin based on methylbis(aminopropyl)amine (Resin 5 in Group (B). Here, the amine has an "original" tertiary amine group, in contrast to Resins 3 and 4, in which a diethylenetriamine polyamide is separately methylated before the epichlorohydrin reaction.

Control Examples U08 and U09 show the non-operability of resins containing quaternary ammonium groups, but no amide groups, as Group (C) components of the resin system of this invention. These are Resin 6 (dimethylamine-epichlorohydrin polymer) and Resin 7 (dimethylaminopropylamine-epichlorohydrin polymer). Note that in Resin 7, the starting amine contains a tertiary amine group. This makes it a very appropriate control, showing the unexpected benefits of amide groups in the Group (C) polymer.

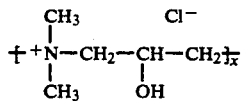

Principal repeating unit of Resin 6

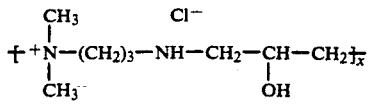

-continued
Principal repeating unit
of Resin 7

Examples U10, U11 and U12, and U15–U16 show that the improved absorbency can be realized at high levels of wet strength. Example U11 and U12, compared to U10 (wet-strength resin+CMC, at approximately equal dry and wet strength), show again the greatly improved absorbency from the three part-system of this invention. Similar results are shown with CMG instead of CMC, in U16 vs. U15. U17 and U18 show once again that the non-amide cationic polymers fail to work.

Examples U17 through U20 show the effects of the nonthermosetting resins by themselves. The Resins 4 and 5, though operable in the method of the invention, did not by themselves significantly affect the absorbency of paper. The inoperable non-amide Resins 6 and 7 impaired absorbency.

Examples U21 through U24 deal with the effects of the nonthermosetting resins plus anionic polymers. U21 shows that Group (C) nonthermosetting Resin 4+Group (B) anionic polymer CMC (Resin 9) did not significantly improve absorbency, and U22 shows that nonthermosetting Resin 5+CMC may have slightly impaired absorbency. In light of these results, it could not have been predicted that the nonthermosetting cationic resin (Group C) in combination with an anionic polymer (Group B) and in the presence of a wet-strength resin (Group A) described above, would improve absorbency to the extent achieved according to the invention.

I claim:

1. A method for improving the absorbency of wet-strength paper made with between about 0.1% and about 2% of a neutral-to-alkaline-curing wet-strength resins, that comprises adding a water soluble carboxyl-containing polymer and a substantially non-thermosetting poly(tertiary amino)amide-epichlorohydrin resin to an aqueous suspension of cellulosic paper stock that contains one or more wet-strength resins selected from the group comprising poly(secondary amino)amide-epichlorohydrin, poly(tertiary amino)amide-epichlorohydrin, poly(tertiary amino)ureylene-epichlorohydrin, polyalkylenepolyamine-epichlorohydrin, poly(diallylamine)-epichlorohydrin, and poly(alkyldiallylamine)-epichlorohydrin resins, in which:

the carboxyl-containing polymer is selected from the group consisting of carboxymethylcellulose (CMC), carboxymethylhydroxyethylcellulose (CMHEC), carboxymethylhydroxypropylcellulose (CMHPC), carboxymethylguar (CMG), carboxymethyl-locust bean gum (CMLB), carboxymethylstarch (CMS), acrylamide-acrylic acid copolymers, and the alkali metal salts or the ammonium salts of CMC, CMHEC, CMHPC, CMLB, CMS, and acrylamide-acrylic acid copolymers;

and the substantially non-thermosetting poly(tertiary amino)amide-epichlorohydrin resin is the reaction product of epichlorohydrin with (1) a poly(tertiary amino)amide selected from the group consisting of a polyamide resulting from the reaction of a dicarboxylic acid having between 2 and about 10 carbon atoms and a polyamine selected from the group consisting of alkylbis(omega-amino)alkylamines having the structure $H_2N—(CH_2)_m—N(R')—(CH_2)_m—NH_2$ in which m is 2 or 3 and R' is an alkyl group containing 1 and 3 carbon atoms and (2) polyamides derived from polyalkylenepolyamines having two primary amine groups and the remainder secondary, of structure $H_2N—[(CH_2)_m—NH]_p—(CH_2)_m—NH_2$ in which m is between 2 and 6 inclusive, and p is between 1 and about 4; the reaction of the acid with 2) being followed by methylation of the poly(secondary amino)amide to a poly(tertiary amino)amide; the mole ratio of epichlorohydrin per formula equivalent of tertiary amine groups in the poly(tertiary amino)amide being between about 0.05 and about 0.35 to 1; and in which between about 0.25 and about 1 part by weight of the non-thermosetting poly(tertiary amino)amide-epichlorohydrin resin is used per part of the wet-strength resin, and between about 0.5 and about 1.2 parts by weight of the carboxyl-containing polymer are used per part of the total of said wet-strength resin and said substantially non-thermosetting resin.

2. A method according to claim 1, in which the wet-strength resin is a poly(secondary amino)amide-epichlorohydrin resin.

3. A method according to claim 2, in which the poly(secondary amino)amide moiety is derived from a dicarboxylic acid containing from 5 to 6 carbon atoms and from diethylenetriamine.

4. A method according to claim 3, in which the poly(secondary amino)amide moiety is derived from adipic acid and diethylenetriamine.

5. A method according to claim 1, in which the carboxyl-containing polymer is selected from the group comprising CMC having a degree of substitution (D.S.) between about 0.6 and about 1.5; CMG having a D.S. between about 0.1 and about 1.0; acrylamide-acrylic acid copolymers containing a mole fraction of acrylic acid between about 5 and about 70 mole percent; their alkali metal salts; and their ammonium salts.

6. A method according to claim 5 in which the carboxyl-containing polymer is selected from the group comprising CMC having a D.S. between about 0.7 and about 1.2, CMG having a D.S. between about 0.2 and about 0.5, acrylamide-acrylic acid copolymers containing a mole fraction of acrylic acid between about 5 and about 20 mole percent; and their alkali metal salts.

7. A method according to claim 1 in which the carboxyl-containing polymer is the sodium salt of CMC having a D.S. about 0.7.

8. A method according to claim 1 in which the polyamides used in the preparation of the substantially non-thermosetting poly(tertiary amino)amide resins result from the reaction of a dicarboxylic acid having between 5 and 6 carbon atoms.

9. A method according to claim 8 in which the alkylbis(omega-amino)alkylamines have the structure $H_2N—(CH_2)_m—N(R')—(CH_2)_m—NH_2$ in which m is 3 and R' is methyl, and the polyalkylenepolyamines have the structure $H_2N—[(CH_2)_m—NH]_p—(CH_2)_m—NH_2$ in which m is 2 and p is between 1 and 2.

10. A method according to claim 9 in which the substantially non-thermosetting poly(tertiary amino)amide-epichlorohydrin resin is the reaction product of epichlorohydrin with a poly(tertiary amino)amide derived from the dicarboxylic acid containing between 5 and 6 carbon atoms and diethylenetriamine.

11. A method according to claim 10 in which the substantially non-thermosetting poly(tertiary amino)a-mide-epichlorohydrin resin is the reaction product of epichlorohydrin with a poly(tertiary amino)amide derived from a adipic acid and diethylenetriamine; in which the mole ratio of epichlorohydrin per formula equivalent of tertiary amine groups in the poly(tertiary amino)amide is between about 0.1 and about 0.3 to 1.

12. A method according to claim 1 in which the substantially non-thermosetting poly(tertiary amino)amide-epichlorohydrin resin is the reaction product of epichlorohydrin with a poly(tertiary amino)amide derived from a dicarboxylic acid containing between 5 and 6 carbon atoms and from methylbis(3-aminopropyl)amine.

13. A method according to claim 12 in which the substantially non-thermosetting poly(tertiary amino)amide-epichlorohydrin resin is the reaction product of epichlorohydrin with a poly(tertiary amino)amide derived from adipic acid and the methylbis(3-aminopropyl)amine, in which the mole ratio of epichlorohydrin per formula equivalent of tertiary amine groups in the poly(tertiary amino)amide is between about 0.1 and about 0.3 to 1.

14. A method according to claim 1 in which the wet-strength resin is an adipic acid-diethylenetriamine polyamide-epichlorohydrin resin, the carboxylated polymer is the sodium salt of a CMC of D.S. between about 0.6 and about 1.2, and the substantially non-thermosetting poly(tertiary amino)-amide-epichlorohydrin resin is formed by the reaction of epichlorohydrin resin is formed by the reaction of epichlorohydrin with a polyamide derived from adipic acid and diethylenetriamine with subsequent methylation of its secondary amine groups, at a ratio between about 0.1 and about 0.3 mole epichlorohydrin per formula weight of tertiary amine group in the polyamide.

15. A method according to claim 1 in which the wet-strength resin is an adipic acid-diethylenetriamine polyamide-epichlorohydrin resin, the carboxylated polymer is the sodium salt of a CMC of D.S. between about 0.6 and about 1.2, and the substantially non-thermosetting poly(tertiary amino)-amide-epichlorohydrin resin is formed by the reaction of epichlorohydrin with a polyamide derived from adipic acid and methylbis(3-aminopropyl)amine, at a ratio between about 0.1 and about 0.3 mole epichlorohydrin per formula weight of tertiary amine group in the polyamide.

16. A method according to claim 1 in which the wet-strength resin is an adipic acid-diethylenetriamine polyamide-epichlorohydrin resin, the carboxylated polymer consists of about 0.5 part (per part of the total wet-strength resin solids and substantially non-thermosetting resin solids) of the sodium salt of a CMC of D.S. about 0.7, and the substantially non-thermosetting poly(tertiary amino)amide-epichlorohydrin resin consists of about 0.25 part to about 1 part (per part of wet-strength resin solids) of the reaction product of epichlorohydrin with a polyamide derived from adipic acid and diethylenetriamine followed by methylation of its secondary amine groups, at a ratio between about 0.1 and about 0.3 mole epichlorohydrin per formula weight of tertiary amine group in the polyamide.

17. A method according to claim 1 in which the substantially non-thermosetting poly(tertiary amino)amide-epichlorohydrin resin consists of from about 0.25 part to about 1 part (per part of the wet-strength resin solids) of the reaction product of epichlorohydrin with a polyamide derived from adipic acid and methylbis(3-aminopropyl)amine.

* * * * *